US007070318B2

(12) United States Patent
Renfro

(10) Patent No.: US 7,070,318 B2
(45) Date of Patent: Jul. 4, 2006

(54) MIXING APPARATUS HAVING ROTATIONAL AND AXIAL MOTION

(76) Inventor: Charles K. Renfro, 146 Volunteer Dr., Elizabethton, TN (US) 37643

( * ) Notice: Subject to any disclaimer, the term of this patent is extended or adjusted under 35 U.S.C. 154(b) by 0 days.

(21) Appl. No.: 10/115,330

(22) Filed: Apr. 2, 2002

(65) Prior Publication Data

US 2002/0154568 A1 Oct. 24, 2002

Related U.S. Application Data

(63) Continuation-in-part of application No. 09/563,465, filed on May 2, 2000, now abandoned.

(51) Int. Cl.
*B01F 7/26* (2006.01)

(52) U.S. Cl. ..... 366/143; 366/169.1; 366/207; 366/251; 366/289; 366/331

(58) Field of Classification Search ..... 366/143, 366/168.1, 169.1, 207, 243, 247, 251, 255, 366/289, 331, 129
See application file for complete search history.

(56) References Cited

U.S. PATENT DOCUMENTS 2,485,982 A * 10/1949 McMillan
2,622,943 A * 12/1952 Wankat et al.
2,758,105 A * 8/1956 Alles et al.
2,816,743 A * 12/1957 Kirkland
2,831,606 A * 4/1958 Alters
3,514,080 A * 5/1970 Price et al.
3,606,094 A * 9/1971 Mills et al.
3,858,853 A * 1/1975 Rausch et al.
4,758,096 A * 7/1988 Gunarsson
5,326,167 A * 7/1994 Ware et al.
5,372,422 A * 12/1994 Dubroy

* cited by examiner

*Primary Examiner*—David Sorkin

(57) ABSTRACT

A mixing apparatus having a rotating blade mixer affixed to the end of a mixer shaft which is rotatably mounted thru a mixer seal member which is adapted to be brought into sealing engagement with the open filler end of a retail tube of viscous caulking compound, wherein the shaft and mixer are adapted to be rotated and reciprocated thru the viscous compound contained in the tube substantially the entire length of the tube to rapidly and intimately mix the compound with colorant injected thereinto directly in the retail tube.

28 Claims, 6 Drawing Sheets

MIXING APPARATUS HAVING ROTATIONAL AND AXIAL MOTION

This application is a continuation-in-part of applicants pending Ser. No. 09/563,465 of same title and filed on May 2, 2000 now abandoned.

BACKGROUND OF THE INVENTION

1. Field

This invention concerns a method and apparatus for mixing any of a wide variety of liquid or particulate materials such as colorant, e.g., pigment or organic dye, sand, grout, catalyst for two part caulking, or the like preferably in solution or suspension form, into viscous work material, particularly caulking compound, wherein the structural mixing components are of unique but simple design and are adapted to accomplish the mixing very rapidly and directly within the work material retail container, i.e., in-situ.

In the use of certain materials such as caulking or other sealing materials which are sold in plastic dispensing tubes such as "DAP® Acrylic Latex Caulk Plus Silicone", it is often desirable to color the material to match, e.g., the wall color being applied to a room. For example, in the use of conventional white caulking material, as soon as the material sets up sufficiently, usually about two hours or longer, the material can be painted the same color as the room. Where the paint is of a light shade in particular, it may be difficult to cover the material completely without multiple paint coats. Also, it is often necessary to do some additional caulking after the final coat of paint has been applied. In that event, the white caulking has to be painted over as the final step. Consequently, some paint dealers have undertaken to mix colorant into the caulking material by hand for certain customers, but considerable time and effort is involved and often results in inferior mixing and considerable clean up time.

The present invention provides a quick, effective, convenient and cleaner method and apparatus for substantially automatically performing the mixing operation.

2. Prior Art

Applicant is unaware of any prior apparatus or method of the type disclosed and claimed herein which is designed to mix colorant directly into caulking compound or the like contained in its retail tube.

SUMMARY OF THE INVENTION

The present invention, in one of its preferred embodiments comprises a mixer head means having a mixer shaft rotatably mounted axially therethrough and having a mixing impeller or blade means affixed to a distal end thereof, a proximal end of said shaft being connected to or connectable to power means for rotating said shaft and impeller means, head means having a first annular sealing surface adapted for making a sealing connection to a second annular sealing surface on an open filler end portion of a tube of viscous caulking compound or the like whereby the combination of said head means and tube is completely portable and independent of other structure, and wherein said shaft with said impeller means is adapted to be rotated and reciprocated thru the viscous compound contained in the tube substantially the entire length of the tube to rapidly and intimately mix the compound with colorant or other additive material placed in the tube.

In certain preferred embodiments:

(a) the blade means is provided at its periphery with a wiping surface adapted to rotatably and longitudinally slide against or in close proximity to the inner surface of the tube whereby no significant amount of unmixed compound or colorant remains;

(b) a colorant supply means is provided to inject the colorant into the compound during reciprocation of the shaft and blade means thru the compound;

(c) the supply means of (b) above comprises passage means extending longitudinally thru the shaft whereby colorant can be either pressure injected or gravity fed at a desired rate therethrough into the compound either before or during rotation and/or longitudinal mixing movement of the shaft thru the compound;

(d) the shaft with mixer blade means is rotatably mounted and supported on rotative power means in a longitudinally stationary position wherein mixer head means is provided for holding the tube filler end and wherein linear power means is provided for longitudinally reciprocating said head means and tube relative to the shaft and mixer blade means;

(e) power means is provided for selectively reversing rotation of the shaft and blade means during the mixing operation to afford maximum mixing turbulence to the compound;

(f) said head means includes rotative power means connected to said proximal end of said shaft for rotating said shaft; and (g) said head means is provided with structure for connecting it to an apparatus which can reciprocate the head and tube relative to said shaft and impeller.

The present mixing method in a preferred embodiment employing a retail, off-the-shelf tube of caulking material wherein the tube has a puncturably sealed dispenser end section, a filler end section having surface portions defining a fill opening into the tube, a thrust cap sealingly, slidably mounted in said filler end section, and further employing a mixer head means adapted to seal against said surface portions of said filler end section during the mixing operation, wherein said head means has mixer shaft means rotatably and axially slidably mounted therethrough, and wherein a mixer impeller means is fixed to a distal end of said mixer shaft means for rotation and axial movement therewith, said method comprising the steps of (a) removing said thrust cap from said tube, (b) adding additive into said tube, (c) connecting said head means to and sealingly against said surface portions of said filler end section to seal said fill opening with said blade means inside of said tube and to provide a portable independent combination of said head means and tube, (d) starting rotation and relative reciprocation of said mixer shaft means within said tube and continuing the rotation and reciprocation for a desired mixing period, (e) removing said tube and the colored compound therein from said shaft, impeller means and head means, and (f) replacing said thrust cap in said filler end section to retain the mixed compound and additive in said tube until use.

BRIEF DESCRIPTION OF THE DRAWINGS

The invention will be further understood from the following description and drawings herein wherein the structures depicted are not drawn to scale or actual relative proportions and wherein portions thereof are cross-sectioned or broken away for clarity, wherein.

DETAILED DESCRIPTION OF THE DRAWINGS

Figure 1:
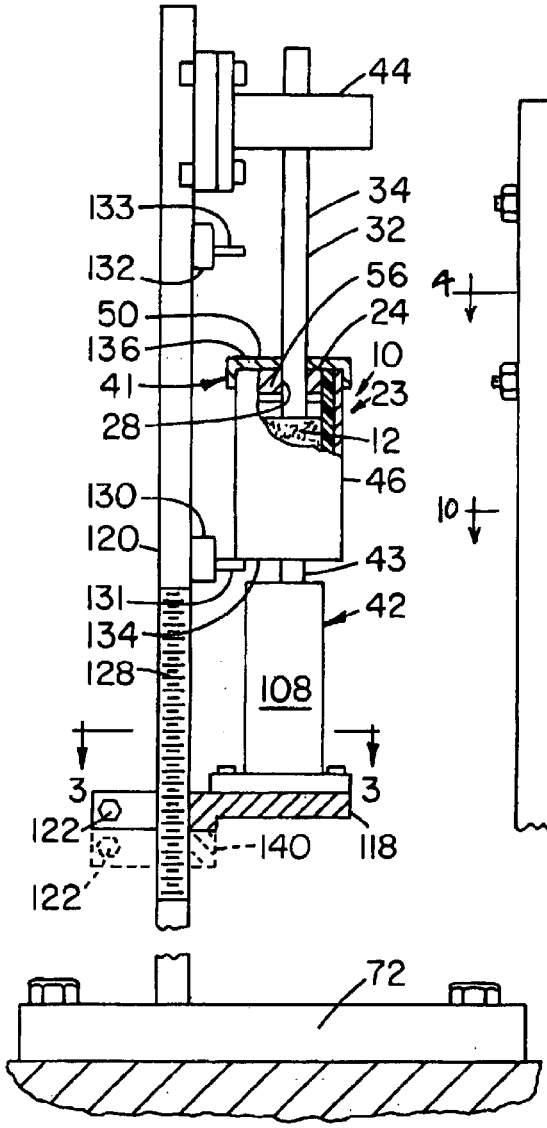
FIG. 1 is a partially sectioned schematic view of an overall mixer apparatus including a fluid, air or hydraulic cylinder for reciprocating the mixing head means and caulking tube.

Referring to the drawings and with particular reference to the claims hereof, the present apparatus in one preferred form and generally designated 10 is well adapted for mixing liquid, solid or suspension colorant or other material with viscous work material 12 such as caulk which is contained in a reservoir 14 of an elongated tube 16, typically of plastic, between a puncturably sealed dispensing end 18 and a filler end 20 normally sealed by a thrust cap seal such as 17. The reservoir is provided by a cylindrical inner surface 22 of the tube and has a substantially uniform diameter throughout its length. One typical caulk tube size is approximately 1 ⅞ O.D. and 8 ½ in., long.

With reference to all of the embodiments shown herein the apparatus in its generic sense comprises mixer head means of metal or plastic material and generally designated 23 having a tube end seal means generally designated 24 adapted to be brought into static engagement by pressure cap means generally designated 41 with wall portions such as the top rim 26 or the upper portions 27 of the interior or outer surfaces of the filler end 20 of the tube to prevent leakage of the work material from the tube during the mixing operation. Bore means 28 is formed thru the seal means 24 substantially on a longitudinal axis 30 of the tube, and an elongated mixer shaft means 32 is mounted thru 28 for both rotational and axial motion with respect to the seal means 24 and tube 16. This shaft means has a proximal end 34 lying axially outwardly of the seal means and has a distal end 36 lying within the reservoir 14. Mixer impeller means 38 is mounted on said distal end and has a periphery 40 adapted to lie closely adjacent to or in sliding contact with cylindrical inner surface 22 of the tube. The above seal means 24, bore means 28, shaft means 32, impeller means 38 and pressure cap means 41 constitute the basic structure of the head means 23. Power means such as 42 is provided for axially moving, in a relative sense, shaft means 32 and impeller 38 substantially completely thru the reservoir of material in a reciprocating manner, and power means such as 44 is provided for rotating the shaft 32 and impeller 38 as they are being moved axially thru the material.

Figure 2:
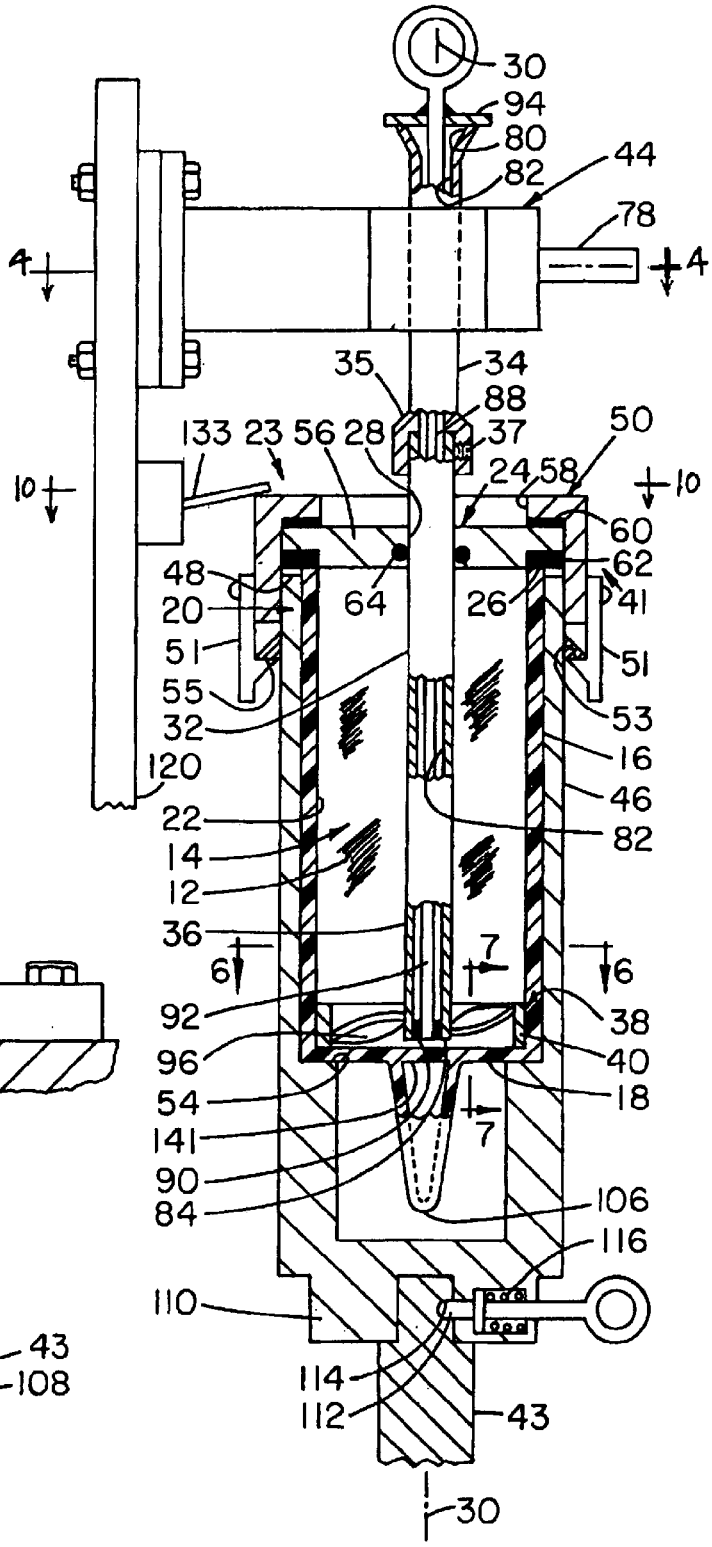
FIG. 2 is a longitudinal partial cross-sectional view of one preferred type of mixing head means for carrying out the present mixing operation wherein the head means and tube are in the up position and wherein the head means has just tripped the top limit switch to reverse the hydraulic cylinder stroke.

In the embodiment shown in FIGS. 1 and 2 the pressure cap means 41 comprises a cylindrical holder section 46 and a pressure cap section 50. The caulking tube is dropped, dispensing end 18 first, with a loose fit between the holder section and tube to allow easy removal of the tube after mixing. In the embodiment of FIG. 2, the top rim 26 of the tube preferably extends slightly above the top rim 48 of the holder section whereby when a pressure cap section 50 is forced down onto the seal means 24, the seal means will seal the tube filler end 20 and said cap section will clamp the ends 20 and 18 of the tube between the seal 24 and a circular ledge 54 on the holder section interior wall. This clamping will prevent rotation of the tube during the mixing operation wherein rotation of the mixer impeller and compound tends to drag the tube into rotation.

Figure 11:
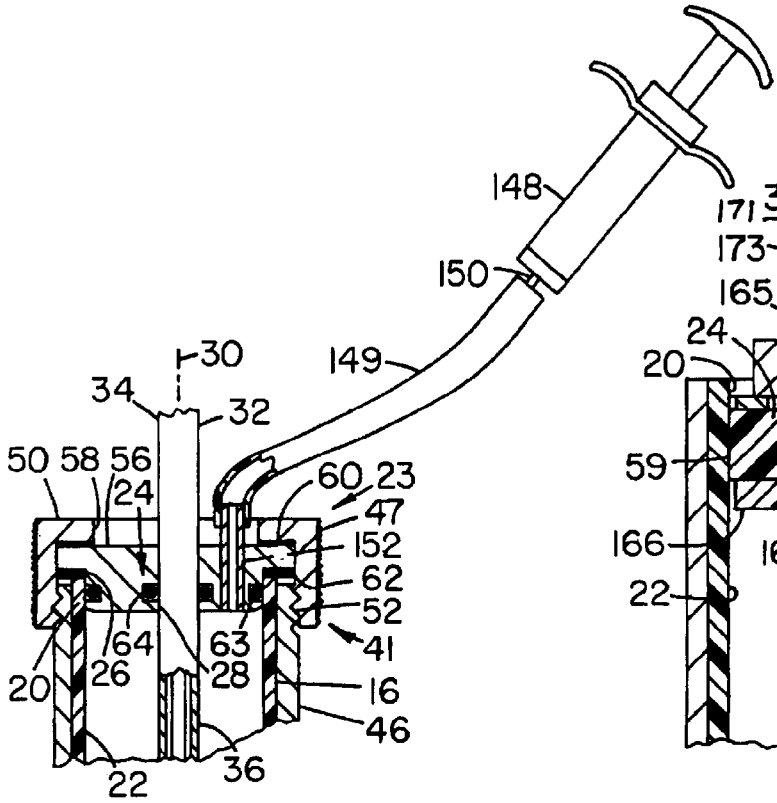
FIG. 11 is a view of the mixer head means on the tube filler end as in FIG. 2 showing a hand held variation of the colorant injection means.

In the embodiment of FIG. 11 a special type of tube end seal means is shown wherein the seal body 56 thereof can be glass, preferably tempered and tough, or clear plastic, and the pressure cap section 50 is formed with a large opening 58 such as to afford a visual inspection of the progress and extent of the colorant mixing operation. An annular cushion 60 of elastomeric material, preferably silicone lubricated, is provided, but not essential, and which, in cooperation with annular elastomeric seal ring 62 cushions the seal body 56. It is noted that where glass is not used, cushion 60 still has utility in providing a slippery surface to facilitate tightening of cap section 50 where threads are employed as shown in FIG. 11, without tending to rotate the seal body 56 and seal ring 62. One or more additional seals such as O-rings 63 may be mounted on 56 if needed.

Shaft means 32 is rotatably mounted thru seal body 56 in all of the embodiments shown, which body is preferably provided with a mixer shaft seal 64 such as an O-ring or other annular ring type seal of composition and configuration which affords an axially sliding seal as well as one which wipes the viscous material from the shaft during reciprocating of the caulking tube.

Figure 4:
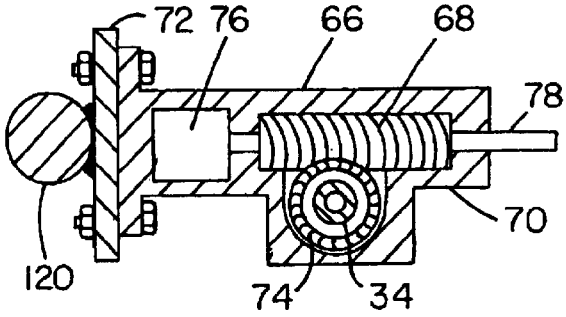
FIG. 4 is a top view of one useful type of worm gear transmission power means for driving the mixing shaft means taken along line 4—4 of FIG. 2, with the gear housing top removed for clarity.
Figure 5:
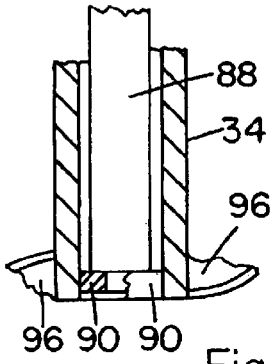
FIG. 5 is an enlarged, for clarity, distal end portion of the mixing blade means and colorant injector piston of FIG. 2.
Figure 8:
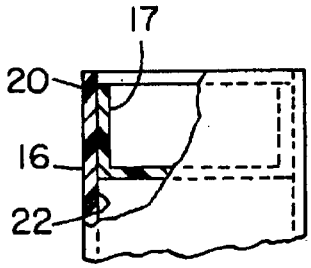
FIG. 8 is a view of the filler end of a typical off-the-shelf caulking compound tube such as DAP® with portions broken away to show the thrust cap in place and which, when pressured further into the tube (down in FIG. 8) by a caulking gun, forces the compound out thru the dispenser nozzle of the tube.

The upper or proximal end 34 of the shaft preferably is mounted thru a rotative power means 44 which can rotate the shaft 32 selectively and substantially instantly in either direction and at any desired rpm, e.g. 600–800 rpm, such that maximum mixing turbulence can be imparted to the work material. One preferred power means is shown in FIG. 4 as a worm gear transmission 66 having a worm shaft 68 rotatably mounted in a housing 70 affixed to a base or frame means 72 of any desired construction which supports the structural components of the present apparatus. Shaft 32 is affixed to a worm gear 74 which mates with shaft 68 and is rotatable thereby. Shaft 68 may be driven by an electric motor 76, preferably variable speed, or by, e.g., reversible electric hand held drill or the like, either house current or battery powered, with its chuck coupled to shaft extension 78, or by a hand crank coupled to 78, all such shaft rotating means being termed herein as power means.

The outermost end 80 of shaft 32 preferably is funnel shaped for facilitating the loading of colorant into passage 82 which is generally axially provided thru shaft 32 and exits thru the inner end 84 of 32. A colorant injection piston rod 88 and annular seal ring 90 affixed to the inner end portion 92 thereof is slidable down into passage 82 and may be employed to forcibly eject colorant which has been loaded into passage 82, into the work material. Rod 88 is preferably provided with a stop means such as collar 94 affixed thereto to allow ring 90 to substantially completely wipe passage 82 clear of colorant but not to allow 90 to pass beyond end 84 of 32 and become damaged. Shaft portion 34 is preferably split and provided with a socket 35 and set screw 37 to allow removal of the shaft from 44 for facilitating cleaning or replacement with a different size impeller blade means 38 and seal means 24.

Figure 6:
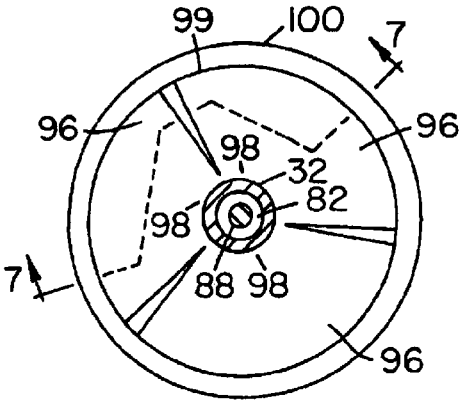
FIG. 6 is a cross-sectional view taken along line 6—6 of FIG. 2 in the direction of the arrows and showing the mixer blade means.
Figure 7:
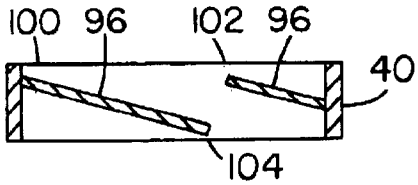
FIG. 7 is a cross-sectional view taken along line 7—7 in FIG. 6 in the direction of the arrows.
Figure 10:
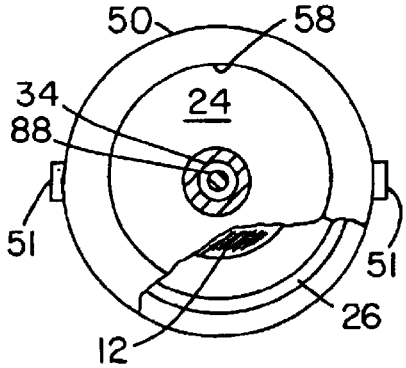
FIG. 10 is a view of the mixer head means taken along line 10—10 of FIG. 2 in the direction of the arrows with portions broken away for clarity.

The mixer impeller or blade means 38 preferably has multiple, e.g., 2–5 blades 96 of any desired shape such as shown in FIGS. 6 and 7 and having their radially inner portions 98 affixed to shaft means 32 and their outer radial portions 99 affixed to cylindrical rim 100. This rim provides peripheral surface 40 which functions to smoothly slide on inner surface 22 of the tube rotationally and linearly to stabilize 32 and 38 and to wipe surface 22 of compound and colorant during the mixing operation. Rim 100 preferably extends slightly above the blades 96 at their upper portions 102 and slightly below the blades at their lower portions 104 such that at the ends of the reciprocation travel, rim 100 will, in the event said travel is slightly unintentionally over extended, engage dispensing end 18 or seal means 24 before the rotating blades can make contact with either or both of 18 or 24 and cause damage thereto or to the blades. It is noted that end 18 is typically of thin plastic such that an operator can easily puncture it with a nail or the like pushed thru the opened nozzle tip 106 when ready for use.

Figure 3:
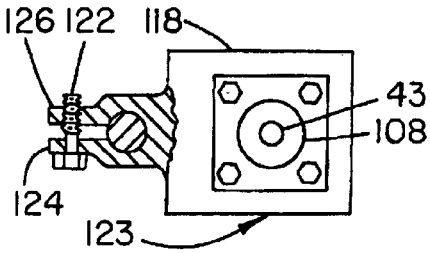
FIG. 3 is a view taken along line 3—3 of FIG. 1 in the direction of the arrows with portions broken away for clarity.

Referring to FIGS. 1–3, the power or lift means 42 preferably is the piston 43 and an automatically two way operating hydraulic or air cylinder 108, and is connected to the base 110 of the holder 46 preferably by a quick disconnect coupling such as pin 112 and socket 114. Compression spring 116 urges pin 112 into 114. Such a coupling allows a quick change of holder 46 to accommodate tubes of different sizes.

In this embodiment, cylinder 108 is mounted on a foot member 118 which is clamped to a stanchion 120 of base or frame means 72 by bolt means 122 slidable thru an aperture in leg 124 and threaded thru a threaded aperture in leg 126. When 122 is loosened, member 118 and attached cylinder 108 and holder 46 can be rotated to the side to allow easy removal or loading of a tube in holder 46. Member 118 can also be slid up or down on stanchion 120 to position holder 46 in the precise vertical position to receive a tube. In this regard, ruler markings 128 can be provided on the stanchion to make easier the proper vertical positioning of 118 for each size tube.

It is apparent that for this embodiment, where tubes of different lengths are used, the travel of piston 43 must be adjusted to give the proper reciprocating stroke length to holder 46, relative to the vertically stationary mixer impeller 38. For this purpose, a cylinder 108 is selected which can readily give the maximum piston stroke required for the longest retail caulking tube which might be used by tradesmen. At the time of this writing about 12 to 14 inches of piston stroke would appear to be more than is needed for the most common reservoir length of retailed tubes of caulking material.

In order to adjust and control the piston stroke length and direction, electrical limit switches 130 and 132 vertically adjustably mounted on frame 72 are adapted to engage their arms 131 and 133 respectively with the bottom 134 and top 136 respectively of holder 46 at the prescribed limits of its reciprocation and, by means of solenoid valves in the hydraulic or air system which are electrically connected to the switches, reverse the direction of hydraulic or air fluid flow and the direction of the piston stroke. Control means are also provided to adjust the speed of the piston reciprocation. In practice, a stroke speed of from about 4 to about 20 seconds per complete up-and-down cycle is desirable, but slower or faster speeds may, of course, be used.

In the operation of the apparatus, a holder 46 of proper dimensions for receiving a particular size caulking tube is connected to piston 43. Foot member 118 is vertically adjusted on stanchion 120 to vertically position the holder where the piston stroke can accommodate the required full up-and-down travel of the holder with room to spare such that impeller 38 can be extracted from the tube after mixing is complete. The limit switches 130, 132 are then vertically adjusted on stanchion 120 of frame 72 and locked into position for being actuated by the bottom and top alternately of the holder at the precise moment that impeller 38 is at the prescribed ends of its reciprocation stroke or travel. The device is now ready to receive a caulking tube 16 from which a thrust cap seal 17 has been removed by, e.g., applying pressure to the tube sides which pops 17 out of the tube.

In order to facilitate vertical loading of the tube into the holder and removing it therefrom, the foot member 118, after loosening bolt 122, is swung to the side 123 such that the holder and tube can clear impeller 38 and any other structure of the device which might be in the way. When it is desirable to maintain the precise vertical position of 118 such as when the device is needed to mix several tubes of the same size, a positioning collar 140 as shown by dotted line in FIG. 1 may be employed to support 118 while it is being rotated.

Figure 9:
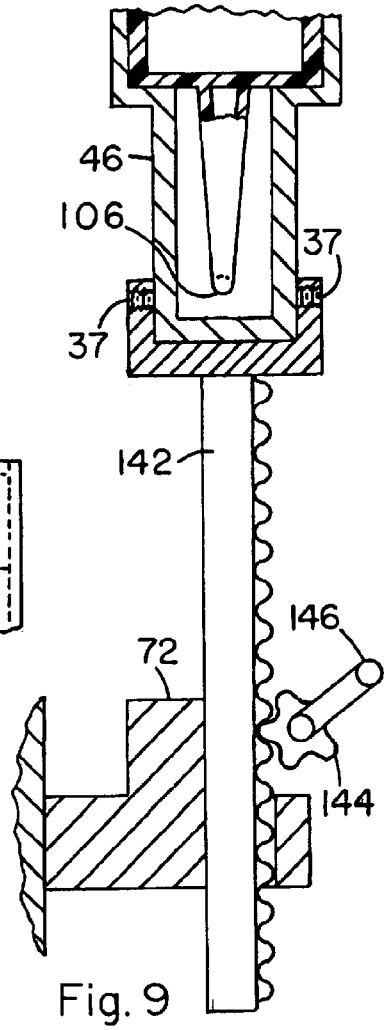
FIG. 9 is a side view, partially sectioned, of a rack and pinion type power means for reciprocating the tube.

As shown in FIG. 9 other types of reciprocating power means may be employed such as rack 142 and pinion gear 144 wherein 144 may be driven by reversible motor means and the travel of 142 controlled by switches such as 130 and 132. Gear 144 may also be fitted within a hand crank 146 if desired.

In the embodiment of FIG. 11, the colorant fluid may be contained in a syringe 148 and a plastic tube 149 provided and connecting the syringe nozzle 150 to a pipe 152 fixed thru the seal body 56. The syringe can be used to inject colorant into the tube before the mixing starts or during the mixing, or both.

In a related embodiment, tube 149 may be rigid or semi-rigid plastic, or metal or ceramic and used, e.g., by inserting it down into the open caulk tube and substantially all the way thru the work material, and the syringe then actuated to inject the colorant into the material as tube 149 is slowly withdrawn therefrom to leave a column of colorant longitudinally in the material. The mixer head means 23 may then be fixed into the open tube end by, e.g., the mechanism of FIG. 13, and the mixing process started by any power means such as a hand drill chucked directly onto shaft portion 34.

It is noted that the configuration of the head means 23, the seal means 24 and the pressure cap means 41 can be varied in accordance with the present invention, such as, for example those shown in FIGS. 2, 11–15 and 20. In FIG. 2, cap section 50 is provided with two or more spring arms 51 which are formed with shoulders 53 adapted to snap in under a shoulder ring 55 affixed around holder 46 as cap section 50 is pushed down over the open neck of the holder with sufficient force to compress seal 62 to a sealing condition. These arms 51 are readily removed from 55 by an outward pull on their lower ends.

In FIG. 11, cap section 50 and the holder section 46 are provided with mating threads 52 such that adequate sealing pressure can be applied to 62 by a small rotating force applied to the cap. Cap section 50 is preferably knurled as at 47 for allowing hand tightening.

Figure 12:
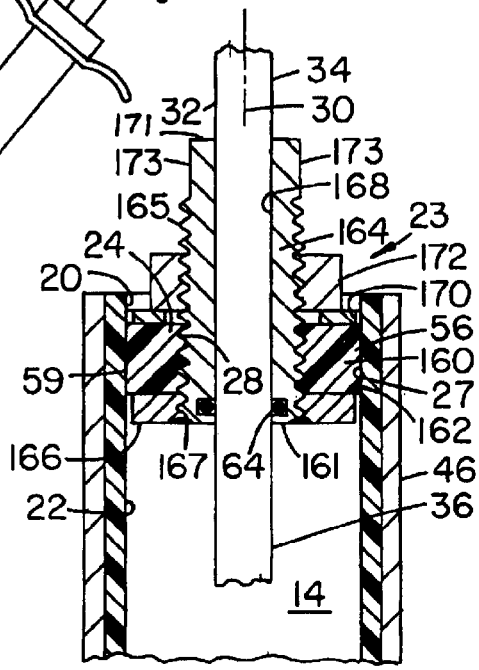
FIG. 12 is a cross-sectional view of the proximal end of the tube and a variation of the mixing head means including a tube holder section.

In FIG. 12 the seal means 24 comprises an elastomeric gripping body 160 having a circular periphery 162 which is dimensioned in diameter to slide down into the filler end 20 of a caulking tube. A bushing 164 having threads 165 is axially mounted thru bore 28 in body 160 and has its inner end 161 non-rotatably fixed to a plate 166 as by welding at 167. Shaft 32 is rotatably, slidably mounted thru a bore 168 in the bushing. A washer 170 is mounted over the bushing and a nut 172 is threaded over the bushing. The upper end 171 of bushing 164 extends an exaggerated amount above nut 172 to provide wrench flats 173 for holding 164 and body 160 from rotating as nut 172 is tightened against washer 170.

In use, shaft 32 is mounted thru bore 168 with the mixer impeller lying adjacent plate 166. With the mixer impeller then inserted into a tube thru the tube filler end thereof, body 160 is slid into the filler end to a desired position therein. A wrench is then mounted on flats 173 to hold bushing 164 and washer 166 stationary, and nut 172 is tightened sufficiently to bulge the body 160 radially outwardly to seal and grip against inner surface 22 of the caulking tube. The elastomeric material of body 160 is selected to allow it to sealingly bulge under just a few pounds of pressure from the tightening nut 172.

With the seal means 24 and mixer impeller means thus positioned in the tube, and with the colorant injected, e.g., deposited in the tube, on or into the work material by drop bottles, syringe, spatula, gel capsules, color packets, mechanical dispenser, or the like, the tube can be hand held or placed within a holder or carriage 77, and the shaft 32 rotated either by a power means such as 44 or, e.g., an electric drill having its chuck fixed to 32. Reciprocation of the mixer head thru the work material relative to the caulking tube can be done by power means such as 42 or by hand.

Figure 13:
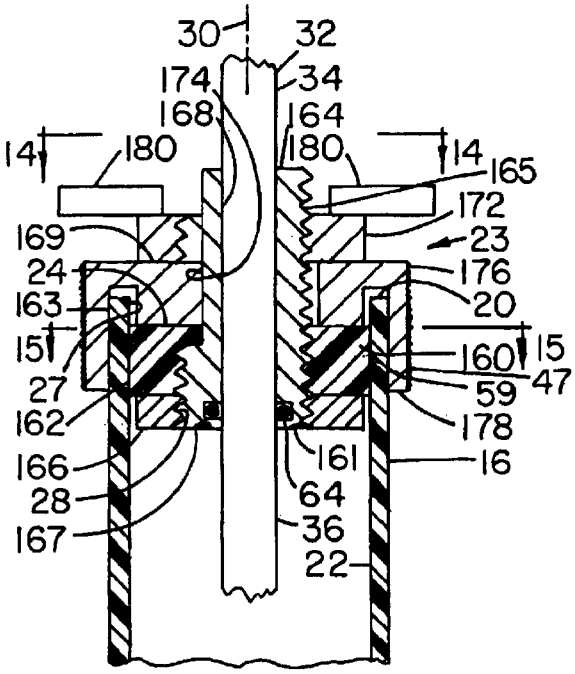
FIG. 13 is a view as in FIG. 12 showing a more preferred type of mixer head means.
Figure 14:
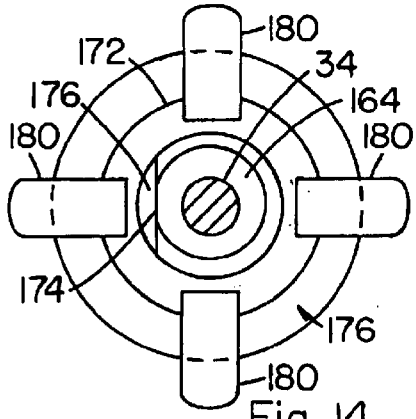
FIG. 14 is a top view of the head means of FIG. 13 taken along line 14—14 thereof in the direction of the arrows.
Figure 15:
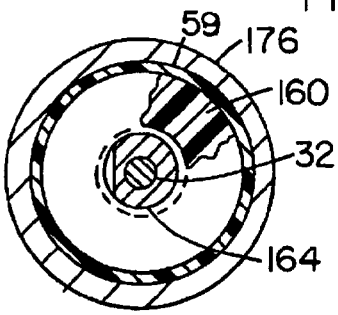
FIG. 15 is a cross-sectional view taken along line 15—15 of FIG. 13 in the direction of the arrows.

Referring to FIGS. 13, 14 and 15 wherein structure substantially equivalent to that of FIG. 12 are numbered the same, bushing 164 is provided with a flat 174 over which a pressure cap 176 of special configuration is mounted. This cap is dimensioned and shaped to slide down over bushing 164 and the open neck 163 of a tube and be held by hand from rotating while nut 172 is tightened against the upper surface 169 of the cap to bulge seal body 160 as at 59. The outer cylindrical wall 178 of the cap prevents excessive outward bulging of the tube neck wherein such bulging might be a problem for some tubes having thin or weak walls. Torque arms 180 on nut 172 allow hand tightening thereof.

Referring to FIGS. 16–31, the best modes presently known for practicing the present invention are shown therein and wherein certain structures are numbered as in FIGS. 1–15.

In the embodiments of FIGS. 16 thru 31, the tube 16 is locked to head means 23 in a manner similar to FIGS. 12 and 13. Referring to FIG. 20, head 23 comprises pressure cap means 41 formed to provide a cylindrical recess wall 57 dimensioned for snugly, slidably receiving the filler end 20 of tube 16. The elastomeric body 56 of seal means 24 is substantially cylindrical in shape in its uncompressed condition but is bulged laterally as shown at 59 in its compressed sealing condition wherein the upper portion 27 of the tube 16 is pressured against the bulge 59 to lock the tube to the head means 23.

Head means 23 further comprises a bushing such as 164 but having a substantially oblong cross-section stem 73 threaded as at 165 and having flats 61 for preventing rotation of the bushing in the mating and substantially oblong aperture 65 provided thru the top 67 of cap means 41 and thru which the bushing can longitudinally slide. A circular tightening knob 69 having internal threads 71 is adapted to be threaded onto bushing 164 and tightened against cap top 67 such that the pressure plate portion 166 of the bushing and top 67 will compress body 56 and bulge it radially to frictionally lock and seal the tube between body 56 and recess wall 57. It is noted that body 56 may have various cross-sectional configurations and constructions such as the elastomeric, resilient air filled doughnut 75 shown in a compressed operational condition in FIG. 27.

Figure 16:
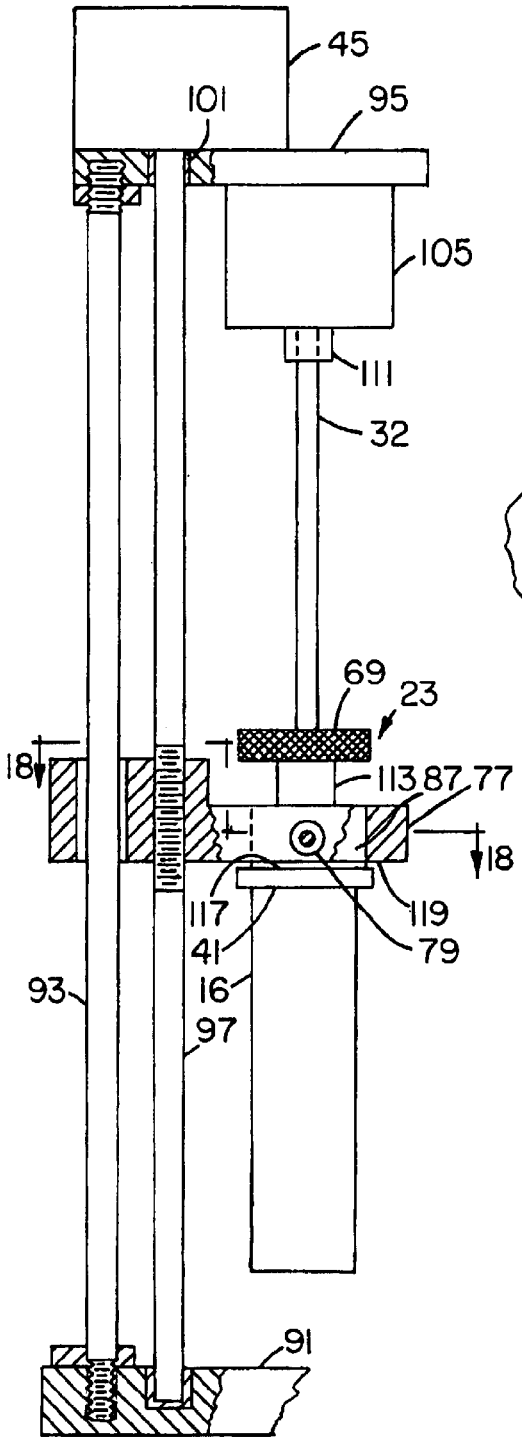
FIG. 16 is a partially sectioned side elevation view of an electrical motor powered reciprocation apparatus with the present preferred mixing head structure mounted on a carriage means.

As shown in FIG. 16 head means 23 with the tube 16 locked thereto is removably affixed to a carriage means 77 of any desired configuration and preferably provided with a retractable positioning pin 79 or equivalent which is adapted to fit within a recess 81 in the wall portion 87 of cap 41 (see FIG. 20) to removably lock head 23 and tube 16 to the carriage 77 in a desired position. Compression spring 83 is compressed between a plug 85 threaded into 77 and a shoulder 86 affixed to pin 79 to continually urge the pin toward an aperture 89 in the carriage, in which aperture the cap 41 is to be locked as hereinafter described.

Figure 17:
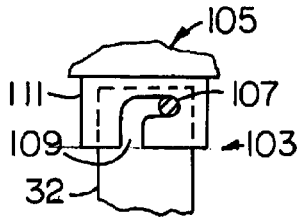
FIG. 17 is an elevation view of a useful means for quickly connecting the mixer shaft to a rotative power source.
Figure 18:
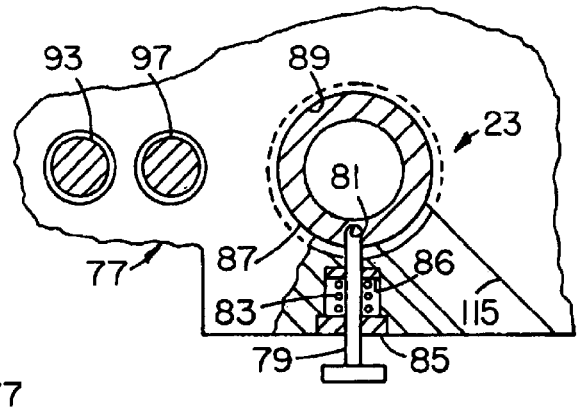
FIG. 18 is a view taken generally along line 18—18 of FIG. 16 in the direction of the arrows.

In FIG. 16 an apparatus is shown for reciprocating the carriage 77 and tube and comprises a base 91 to which is affixed a stanchion 93 which is slidably mounted thru the carriage and supports at its upper end a header means 95. A threaded spindle 97 is rotatably mounted on base 91 and is threaded thru the carriage and rotatably passes thru a bearing 101 in 95. An electric motor 45 or equivalent is mounted on 95 and its output shaft is connected to spindle 97. This motor is preferably adapted to rotate the spindle at any desired speed and to reverse its rotational direction in order to cycle the carriage and tube up and down at a rate to achieve good mixing. Another electric motor 105 or equivalent is mounted on 95 and is adapted for connection to shaft 32 by a bayonet type connector 103 or equivalent as shown in FIG. 17 wherein pin 107 is on shaft 32 and slot 109 is on the output shaft 111 of the motor.

The assembly of the head 23 on the carriage 77 with tube attached in operating condition with shaft 32 extending outwardly a desired extent is carried out by positioning the neck portion 113 of the head into channel 115 in the carriage, pulling pin 79 outwardly from aperture 89, moving 113 inwardly until wall portion 87 is laterally within the perimeter of aperture 89, thrusting the head upwardly until shoulder 117 thereon abuts the underside 119 of the carriage, releasing pin 79 to allow it to engage against wall portions 87, and rotating the head until the pin automatically inserts into recess 81 by way of spring 83. At this point the shaft 32 can be extended upwardly by the operators hand force to make the connection shown in FIG. 17. It is noted that where reverse rotation of shaft 32 is desired, a type of connector other than 103 should be used such as, e.g., a set screw. The length of stroke of the carriage is preferably regulated by limit switches or the equivalent in the manner shown in FIGS. 1 and 2. Other types of regulatory means such as light or other radiation sensing devices may, or course, be employed.

It is noted that for any of the embodiments shown herein the head 23, carriage 77 and tube 16 may be held stationary while the shaft 32 and motor 105 are reciprocated. Such a variation is readily made, for example, by attaching the carriage 77 in fixed position on a lower portion of stanchion 93 and disconnecting it from spindle 97, and removing motor 105 from header 95 and affixing it to a carriage such as 77 as the carriage and its mounting are shown in FIG. 16.

Figure 19:
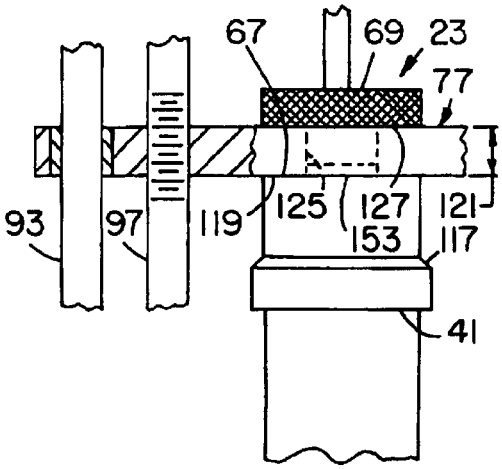
FIG. 19 is a view as in FIG. 16 of a variation in the connection of the carriage means to the mixer head means.
Figure 20:
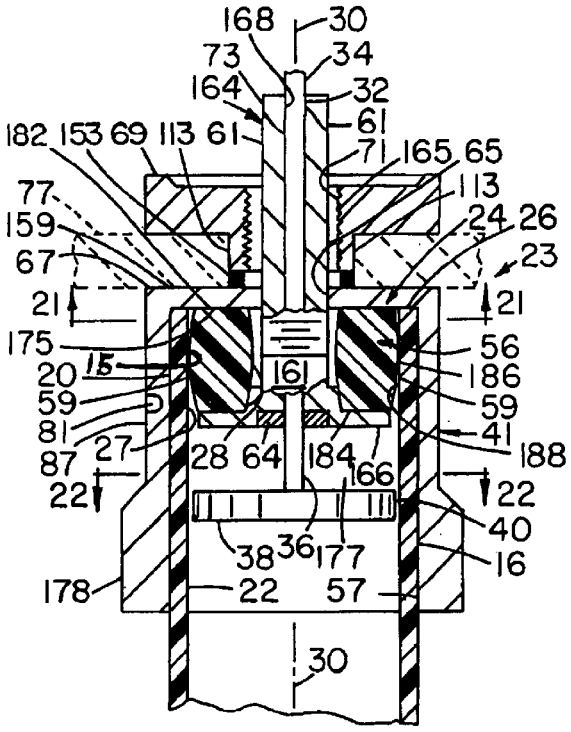
FIG. 20 is a longitudinal cross-section of a preferred head means.
Figure 20A:
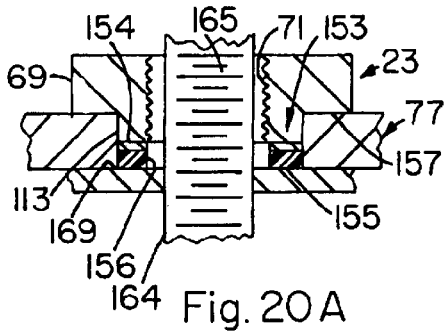
FIG. 20A is an enlarged cross sectional view of the portion of head 23 which clamps onto carriage 77.
Figure 21:
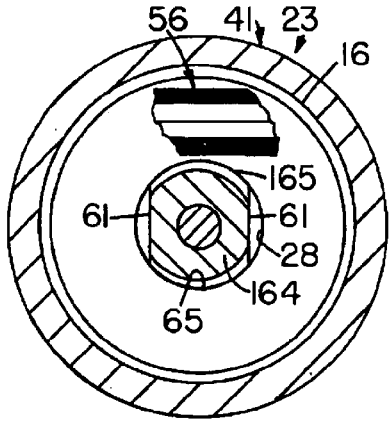
FIG. 21 is a cross-sectional view taken along line 21—21 of FIG. 20 in the direction of the arrows and showing only a portion of body 56 in elastomeric cross-section.

Referring to FIGS. 19, the phantom lines of 77 in FIG. 20, and to FIG. 20A the assembly of head 23 with carriage 77 can be done by way of (1) making the aperture 89 of a diameter approximately the same as the width of channel 115 which preferably is only slightly wider than the diameter of neck 113 of the tightening knob 69, (2) dimensioning the head components and the thickness 121 of the carriage such that with the tube 16 clamped by an initial force to the head, the neck 113 can be slid thru channel 115 to aperture 89 and the knob 69 then further tightened a small but sufficient degree to clamp the carriage between the underside 127 of the knob and the top 67 of the pressure cap 41, and (3) employing a compressible pressure element such as 153 comprised of an annular metal washer component 154 and an annular elastomeric buffer component 155 wherein bushing 164 is slidable thru the center opening 156 of said element and wherein said buffer component is less compressible than body 56 such that seal body 56 will bulge tightly against the tube wall before said buffer component compresses to the point where the underside 157 of knob 69 tightly engages carriage 77. It is preferred that 154 and 155 be adhesively affixed to each other and that 156 be adhesively affixed to the top 67 of pressure cap means 41.

Figure 23:
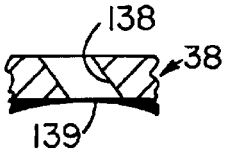
FIG. 23 is a cross-sectional view of the impeller taken along line 23—23 in FIG. 22 in the direction of the arrows.
Figure 22:
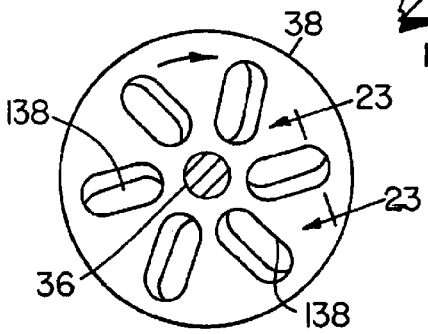
FIG. 22 is a view of a highly preferred impeller taken along line 22—22 in FIG. 20 in the direction of the arrows.
Figure 24:
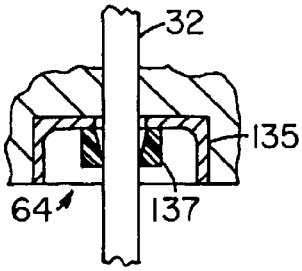
FIG. 24 is a cross-sectional view of a preferred shaft seal mounted in the bushing.

The most preferred shaft seal 64 is shown in FIG. 24 wherein an annular metal housing 135 is adhesively affixed to an annular or ring seal 137 of elastomeric material. The most preferred impeller 38 is disc shaped as shown in FIGS. 22 and 23 wherein the mixing blades are in the form of slots 138 tapered from about 30 to about 50 degrees, and wherein the direction of rotation of shaft 32 is clockwise. The construction greatly reduces the whipping of air into the caulk mass during mixing. The bottom 139 of the impeller disc is slightly concaved such that the tube seal 141 will not be damaged if the impeller comes into contact with the tube bottom.

Figure 26:
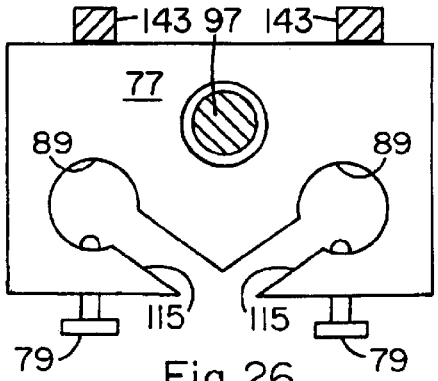
FIG. 26 is a top view of a multiple head carrying carriage.
Figure 27:
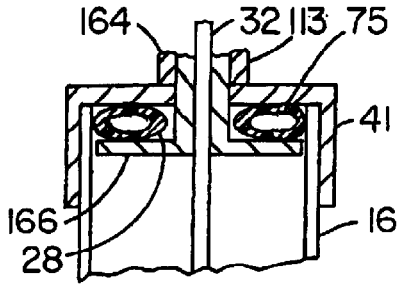
FIG. 27 is a partial view of the head means of FIG. 20 and showing a variation in the structure of seal body 56.
Figure 29:
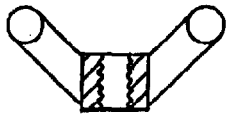
FIG. 29 shows in an alternative tightening means structure for knob means 69 in FIG. 20.

As shown in FIG. 26 multiple channels 115 and apertures 89 may be provided in the carriage 77 for simultaneous multiple mixings. Stanchion slide guides such as 143 against which the carriage is vertically slidable may be provided to prevent rotation of the carriage during mixing. In FIG. 29 an alternative to knob 69 is shown as a pair of opposed arms having smooth hemispherical ends 145 for easy gripping and rotation.

Figure 28:
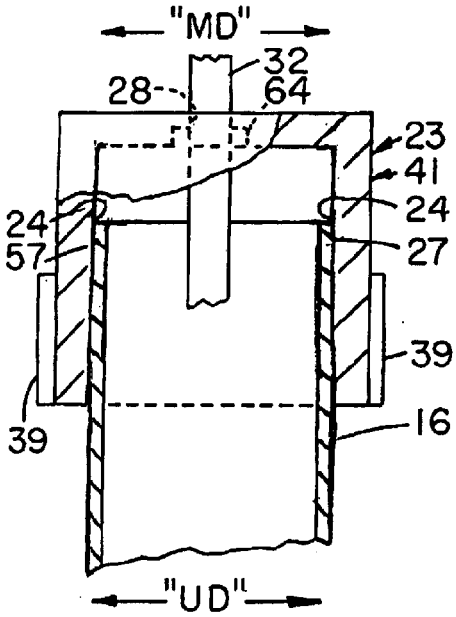
FIG. 28 shows a variation in mixing head structure.
Figure 30:
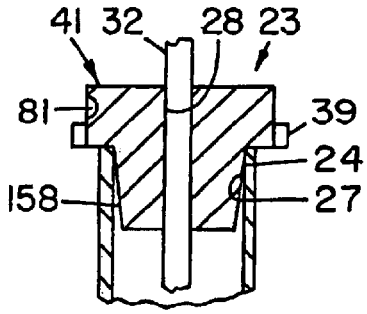
FIG. 30 is a cross-sectional view of a variation of the tapered seal construction of FIG. 28 wherein inner portions of the tube filler end wall provide a component of the seal.

Referring to FIG. 28, the seal means 24 comprises a slightly tapered, e.g., 1–5 degrees cylindrical recess wall 57 into which the open filler end of tube 16 is pushed. The frictional contact of the tube with wall 57 is sufficient to seal the tube end and stabilize the shaft 32 axis and impeller within the tube such that rotation and reciprocation of the shaft can proceed smoothly without dislocation of the head 23 from the tube. In FIG. 30 the tapered wall 158 provides the seal and frictional lock of the head to the tube.

For these embodiments which afford quick and easy on-the-job mixing, the cap 41 is preferably provided with ridge projections 39 spaced around the cap for gripping such that in addition to pushing or pulling the tube, rotation of the cap on the tube can be facilitated to ensure proper sealing and to assist in removal of the tube from the head. Also for this embodiment the rotative power means preferably comprises a hand or palm held and small size battery operated electrical motor with its output shaft integral with shaft 32 such that all of the structures of head means 23 desired for convenient and expeditious mixing are integrated into a single hand held unit falling within the ambit of "combination" as used herein.

It is noted that the head variations of FIGS. 28 and 30 may be provided with means for mounting them on carriage 77 such as recess 81 formed in the sides thereof for receiving a pin such as 79.

Figure 25:
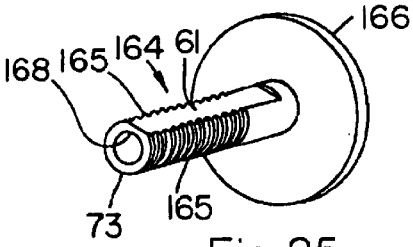
FIG. 25 is a perspective view of the bushing of FIG. 20.

A preferred embodiment of the present mixer head means (or apparatus or mixing device) with exemplary but not limiting structure denoted by structure characters is as follows, A mixing device 23 adapted for attachment to an open filler end 20 of an elongated cylindrical walled tube 16 having a dispensing end sealed by a partition 255, a longitudinal axis 30 and containing viscous material into which additive is to be mixed by said device within the tube itself, wherein the wall inner surface 188 between said filler end and said partition is of uniform diameter, and wherein the inner surface 201 of said partition is substantially planar and oriented normal to said longitudinal axis, said device comprising a filler end seal body 56, 241 having a circular sealing periphery 186 adapted to be wedged against said wall inner surface 188 within said filler end a filler end to frictionally clamp said body against and seal the same to said wall inner surface to prevent leakage of material from said tube during the mixing of additive into said material, said body having a mixer shaft circular bore 28 axially formed therethrough, an elongated mixer shaft 32 of uniform diameter slidably, axially mounted thru said shaft bore and having a proximal end portion 34 (operating end portion 21) extending axially outwardly of said seal body, and further having a distal end portion 36 (mixing end portion 19) extending axially inwardly of said body and having a distal innermost terminus 193, a generally disc shaped mixer impeller 38 having a substantially planar bottom distal surface 139 and being formed with a circular, material wiping periphery 40 conjoined to a center portion 259 having a plurality of material flow-thru apertures 138 formed therethrough, said impeller being fixed axially at its center portion 259 to said terminus 193 with the plane 247 of said bottom distal surface thereof oriented normal to the shaft axis whereby said bottom distal surface can be brought contiguous to said inner surface 201 of said partition during reciprocation of said shaft to thereby contact and mix substantially all of said material and additive, and force applicator shoulder structure 164, 166, 167, and 169 of FIGS. 12, 13, 20 and 21, or the structure 41 of FIGS. 25 and 30, on said device for receiving manual tightening force for forcing said sealing periphery of said seal body 56, 241 into clamping, sealing engagement with said wall inner surface at said filler end of said tube.

Also preferred is the device described above wherein seal body 56 is of resilient, elastomeric material having a bushing bore 11 formed axially therethrough, wherein said force applicator shoulder structure comprises a pressure cap member 41 having a proximal pressure surface 159, a distal pressure surface 175, and a bushing bore 65, an elongated bushing 164 mounted axially thru said bore 65 and having a proximal threaded stem portion 73 and a distal pressure plate portion 166 providing a pressure surface 151, wherein a mixer shaft bore 168 is provided axially thru said bushing 164, wherein ends 182 and 184 of body 56 are adapted to be forcefully engaged by distal pressure surface 175 and pressure surface 151 respectively, and wherein a threaded, hand operable compression handle means 69 is threaded onto stem portion 73 of bushing 164 and is adapted to be tightened against surface 159 to axially compress and radially bulge seal body 56 as at 59 against the tube wall inner surface 188.

Also preferred is the device described above wherein said sealing periphery 186 comprises circumferential portions of a tapered wall 158 of a generally stopper shaped body 241, and wherein said force applicator shoulder structure comprises a cap portion 41 of said body 241, whereby an operators fingers can grip 41 and either push body 24 into a tube or pull said body therefrom.

Also preferred is the device described above wherein said seal comprises a body 56 of resilient, elastomeric material having a bushing bore 11 formed axially therethrough, wherein said force applicator shoulder structure provides seal body clamping structure comprising a pressure cap member 41 having a top portion 67 having a proximal pressure surface 159, a distal pressure surface 175 and a depending compression wall portion 87 having an inner cylindrical pressure surface 31 defining a tube receiving cavity 177, a bushing bore 65 axially formed thru said top portion, an elongated bushing 164 mounted axially thru said bore 65 and having a proximal threaded stem portion 73 on its proximal end 179 and a distal pressure plate portion 166 having a pressure surface 151, wherein a mixer shaft bore 168 is provided axially thru said bushing, wherein ends 182 and 184 of body 56 are adapted to be forcefully engaged by distal pressure surface 175 and pressure surface 151, and wherein a threaded compression handle 69 is threaded onto stem portion 73 and is adapted to be tightened against surface 159 to clamp and radially bulge seal body 56 against the tube wall surface 188 and to force portions 27 of a tube having its filler end positioned in said cavity 177 radially against the inner pressure surface 31 of compression wall portion 87 to thereby further frictionally lock said tube to said device.

Also preferred is the device described above wherein a mixer shaft seal structure 64 is frictionally mounted in a recess 261 formed in plate 166 and is provided with an elastomeric seal member 137 having a circular bore 253 thru which shaft 32 is frictionally slidably mounted, and wherein said seal member 137 is in the general shape of a cup with the rim thereof facing in a proximal direction.

Further preferred is the device described above wherein said bushing bore 65 is generally oblong in shape and wherein said bushing is provided with flats 61 to slidably mate with oblong bore 65 to prevent said bushing from inopportune rotation during tightening of handle 69 on said bushing.

Further preferred is the device described above wherein said circular sealing periphery comprises a circular segment 24 of cylindrical recess wall 57, and said force applicator shoulder structure comprises a top portion pressure cap 41 which can be gripped by the operators hand while said filler end is being forced up into 41, and particularly wherein said wall 57 is tapered outwardly from its proximal end 263 to its distal end 265 at an angle of from 1–5 degrees with respect to parallels 267 and 291 of axis 30.

In order for the preferred and best mode embodiments of the present invention to work properly and to produce the most convenient and expeditious mixing results, the pressure cap means 41 must be so constructed that it does not interfere with or impede the operators hand gripping of the tube 16 as the operator is assembling or disassembling the head 23 and tube and, if desired, as the operator is holding the tube during the mixing operation. To this end and with the cap affixed to the tube, the downwardly depending wall 178 or other portions of the pressure cap should allow at least about a hands width of at least about four inches of the tube dispensing end 18 to protrude beyond wall 178. Therefore, it is preferred that a total length of the cylindrical recess wall 57 of pressure cap means 41 does not exceed three inches even where a reciprocating apparatus as shown in FIG. 16 is employed since proper placement of the head and tube in the carriage means 77 is greatly facilitated where the operator can hand grip the tube. It is noted that an experienced operator by hand gripping a tube 16 can remove thrust cap seal 17, feed additive thru the tube filler end 20, assemble the head 23 onto the filler end 20, run and reciprocate the shaft 32 and impeller 38 to mix the components, remove the head from the tube, and replace seal 17 in the tube in less than 30 seconds, particularly when the combination is only hand supported during the mixing operation.

The invention has been described in detail with particular reference to preferred embodiments thereof, but it will be understood that variations and modifications will be effected with the spirit and scope of the invention.

I claim:

1. Apparatus for mixing colorant with viscous material which is contained in a reservoir (14) of an elongated cylindrical walled tube (16) between a sealed dispensing end (18) and an open filler end (20) thereof, said reservoir being provided by a cylindrical inner surface (22) of the cylindrical wall of said tube and having a substantially uniform diameter, said apparatus comprising a filler end seal (24) adapted to be brought into static engagement with inner wall surface portions (188) of said tube adjacent said filler end opening with sufficient radial force against said wall portions to require an axial pull force on said seal of at least about three pounds to extract said seal from said filler end, whereby said tube is locked and sealed to said seal to prevent leakage of said material from said reservoir (14) during a mixing operation, a bore (28) formed thru said seal (24) substantially on a longitudinal axis (30) of said tube, an elongated shaft (32) mounted thru said bore for both rotational and axial motion relative to said seal and said tube, said shaft having a proximal end (34) lying axially outwardly of said seal and having a distal end (36) lying within said reservoir, a mixer impeller (38) mounted on said distal end and having peripheral portions (40) adapted to lie closely adjacent to said inner surface of said tube, a first power mechanism is provided for causing relative axial motion between said tube and said shaft and impeller substantially completely thru said reservoir of material in a reciprocating manner, and a second power mechanism is provided and is engageable with said shaft for rotating said impeller as it is being moved thin said material.

2. The apparatus of claim 1 wherein passage means is formed generally axially thru said shaft whereby fluid colorant can be fed to said material after said filler end seal is placed in sealing position against said wall surface portions (188) of said filler end.

3. The apparatus of claim 1 wherein said peripheral portions are comprised of a cylindrical member affixed to radially outer portions of said impeller.

4. The apparatus of claim 3 wherein said cylindrical member is provided at its periphery with a wiping surface adapted to rotatably and longitudinally slide against or in close proximity to the inner surface of the tube whereby no discernible unmixed material or colorant remains.

5. The apparatus of claim 1 wherein a colorant supply means is provided to inject the colorant into said material during reciprocation of said shaft and mixer impeller thru said material.

6. The apparatus of claim 5 wherein said supply means comprises passage means extending longitudinally thru said shaft whereby colorant can be either pressure injected or gravity fed at a desired rate therethrough into said material either before rotation and/or longitudinal mixing movement of said shaft and impeller thru said material.

7. The apparatus of claim 1 wherein said shaft is supported on a base in a stationary position and holder structure is provided for holding said tube and reciprocating it and said filler end seal relative to said shaft.

8. The apparatus of claim 1 wherein said second power mechanism is adapted for selectively reversing rotation of said shaft and impeller during the mixing operation to afford maximum mixing turbulence to said material.

9. The apparatus of claim 1 wherein said seal (24) comprises a readily deformable elastomeric body (56) having a substantially circular periphery (186) formed around a central axis (30) and having a substantially flat top end (182) and a substantially flat bottom end (184) and adapted to be slid down into said open filler end of said tube, a bore (28) axially provided thru said body, a shaft (32) mounted thru said bore and slidable thru said bore, and clamping structure adapted to engage said top and bottom ends of said body with sufficient force to bulge said body radially and seal said periphery (186) against said inner wall surface portions (188) of said tube.

10. The apparatus of claim 9 wherein said clamping structure comprises a pressure cap member (41) having a top portion (67) having a proximal pressure surface (159), a distal pressure surface (175) and a depending compression wall portion (87) having an inner cylindrical pressure surface (31) defining a tube receiving cavity (177), a bushing bore (65) axially formed thru said top portion an elongated bushing (164) mounted axially thru said bore (65) and having a proximal threaded stem portion (73) and a distal pressure plate portion (166) having a pressure surface (151), wherein a mixer shaft bore (168) is provided axially thru said bushing, wherein ends (182) and (184) of body (56) are adapted to be forcefully engaged by distal pressure surface (175) and pressure surface (151), and wherein a threaded compression knob is threaded onto stem portion (73) and is adapted to be tightened against surface (159) to clamp and radially bulge seal body (56) against the tube wall surface (188).

11. The apparatus of claim 1 wherein said seal is comprised of transparent material selected from the group consisting of glass or clear plastic.

12. A unitary structural combination of a mixer head and a cylindrical wall tube of substantially uniform diameter and containing viscous material, said tube and head having coincident axes, said combination being adapted for mixing additive with said viscous material which is contained in said tube between a sealed dispensing end and an open filler end thereof, said tube wall providing an annular first sealing surface adjacent said filler end, a generally axially extending wall on said head providing an annular second sealing surface on said head, said sealing surfaces being in forceful contact with each other and forming a seal therebetween, an axial bore formed thru said head, a mixer shaft slidably mounted thru said bore and having a proximal end and a distal end, and a mixer impeller affixed to said distal end, said impeller having a circular periphery of a diameter substantially the same diameter as said tube and adapted to wipe the inner wall of said tube during reciprocation therethrough, wherein apertures are provided thin said impeller for allowing reciprocation thru said material, said seal further providing a physical frictional connection between said tube and head whereby a direct axial pull force of at least about three pounds would be required to disengage said tube from said head.

13. The combination of claim 12 wherein force application means is provided on said head and forcing said second sealing surface into sealing engagement with first sealing surface.

14. The apparatus of claim 13 wherein said head (23) comprises a body (241) having distal tapered cylindrical wall (158) and a proximal pressure cap portion (41), said cap portion providing a hand grip and adapted to extend above said tube filler end (20) when said filler end wall surface (188) is in sealing position adjacent proximal portions (186) of wall (158).

15. The apparatus of claim 14 wherein said body (241) is of substantially rigid material.

16. The apparatus of claim 15 wherein the taper of said wall (158) is at an angle of from about 1.0 to about 5.0 degrees.

17. The combination of claim 12 wherein said second sealing surface is tapered generally axially and is wedged against said first sealing surface.

18. The combination of claim 17 wherein the taper of said second sealing surface provides a minimum diameter "MD" thereto which is from about 0.004 in., to about 0.060 in., smaller than the uncompressed, non-tapered diameter "UD" of said first sealing surface.

19. A unitary structural combination of a mixing apparatus (10) and a cylindrical walled tube (16), said tube being of substantially uniform diameter and providing a mixing cavity (14) for containing components (13) to be mixed together, said tube and apparatus having substantially coincident longitudinal axes (30), and said tube having a sealed dispensing end portion (18) and an open filler end portion (20), wherein an inner surface of the tube wall portion (15) at said filler end portion provides a hermetic sealing surface (188), and wherein said apparatus is frictionally affixed to said filler end portion in operable mixing position with a fictional force which would require an outward axial pull on said apparatus of greater than about three pounds to extract said apparatus from said tube, said apparatus comprising mixer head (23) having a pressure cap member (41) with a top portion (67) having an axially outer proximal surface (159) and an axially inner distal surface (175), wherein a bushing bore (65) is formed axially through said top portion, a radial compression wall portion (87) depends distally and axially from said top portion wherein a radially inner generally cylindrical pressure surface (31) of wall portion (87) provides a cylindrical tube receiving pocket (25) of a diameter substantially the same as the outside diameter of said tube and slidably receives said filler end portion thereof, an elongated bushing (164) mounted thin said bushing bore (65) with a proximal end portion (179) thereof extending above said top portion (67) and provided with laterally extending first shoulder structure (165), a distal end portion (161) of said bushing extending into said cavity (14) and provided with laterally extending second shoulder structure (166), a filler end portion seal (24) having a generally axial cylindrical configuration with a thick, deformable, elastomeric seal body (56) having a circular periphery (186) top (182) and bottom (184) surfaces and being axially mounted on said bushing between said inner distal surface (175) of said cap member (41) and said second shoulder structure (166) of said bushing, the periphery of said second shoulder member (166) being substantially coincident with the radially outer periphery (186) of said body (56), said body having, in its relaxed condition, a diameter slightly less than the inside diameter of said tube whereby said body can be easily slid in and out of said filler end portion, axially operating compression means (69) engaging said first shoulder structure (165) and said outer proximal surface (159) of said top portion and pulling said second shoulder structure (166) against said bottom surface (184) of said body and forcing said top surface (182) of said body against said inner distal surface (175) of said top portion (67) whereby said body is axially compressed and radially expanded and said outer periphery (186) of said body has been forced radially against said cavity sealing surface (188) of said filler end portion (20) and has radially expanded said filler end portion wall portion (15) tightly against said pressure surface (31) of said cap member (41) and frictionally locked said apparatus to said tube preparatory for the mixing operation, a shaft bore (168) is formed thru said bushing substantially on said longitudinal axis, elongated mixer shaft (32) is mounted thru said shaft bore for reciprocating axial motion relative to said tube, said shaft having an operating end portion (21) lying outwardly of said cavity (14) and having a mixing end portion (19) adapted to be axially reciprocated in and out of said cavity and thru said components therein, a mixer impeller (38) is mounted on said mixing end portion and has peripheral portions (40) adapted to lie closely adjacent to said inner surface (22) of said tube during reciprocation of said shaft to wipe said components from said inner surface, said operating end portion (21) being adapted for engagement with a manual or machine power source for axially reciprocating said shaft and impeller substantially completely thru components contained in said cavity (14), wherein the physical frictional engagement of said filler end portion (20) of said tube with said apparatus is sufficiently strong to require a direct axial pull force substantially greater than the reciprocation force to be applied to said shaft in order to accidentally disengage said tube from said apparatus.

20. A mixing device adapted for attachment to an open filler end of an elongated cylindrical walled tube having a longitudinal axis and a dispensing end sealed by a puncturable partition, and containing viscous material into which additive is to be mixed by said device within the tube itself, wherein the inner surface of said partition is substantially planar and oriented normal to said longitudinal axis, said device comprising a filler end seal having a circular sealing periphery adapted to be wedged against the tube wall at said filler end to frictionally clamp said seal against and seal the same to said tube wall to prevent leakage of material from said tube during the mixing of additive and viscous material therein, said seal having a circular shall bore formed axially therethrough, an elongated mixer shaft of uniform diameter and smooth outer surface slidably, axially mounted thru said shaft bore and having a proximal end portion extending axially outwardly of said seal, and further having a distal end portion extending axially inwardly of said seal and having a distal innermost terminus, a generally disc shaped mixer impeller having a substantially planar bottom distal surface and formed with a circular, material wiping periphery conjoined to a center portion having a plurality of material flow-thru apertures formed therethrough, said impeller being fixed axially at its center portion to said terminus with the plane of said bottom distal surface thereof oriented normal to the mixer shaft axis whereby said bottom distal surface can be brought contiguous to said inner surface of said partition during reciprocation of said shaft to thereby contact and mix substantially all of said material and additive, and force applicator shoulder structure on said device for receiving manual tightening force for forcing said sealing periphery of said seal into clamping, sealing engagement with said tube wall at said filler end thereof.

21. The device of claim 20 wherein said seal is in the form of a cylindrical body (56) of resilient, elastomeric material having a bushing bore (11) formed axially therethrough wherein said body is dimensioned to slidably fit down into said open filler end of said tube which has an inner wall surface (188) diameter substantially the same as the outside diameter of said body, wherein said force applicator shoulder structure comprises a pressure cap member (41) having a proximal pressure surface (159), a distal pressure surface (175), and a bushing bore (65), an elongated bushing (164) mounted axially thru said bore (65) and having a proximal threaded stem portion (73) and a distal pressure plate portion (166) providing a pressure surface (151), wherein a mixer shaft bore (168) is provided axially thru said bushing (164), wherein ends (182) and (184) of body (56) are adapted to be forcefully engaged by distal pressure surface (175) and pressure surface (151) respectively, and wherein a threaded, hand operable compression handle (69) is threaded onto stem portion (73) of bushing (164) and is adapted to be tightened against surface (159) to axially compress and radially bulge seal body (56) as at (59) against said inner surface (188).

22. The device of claim 21 wherein said bushing bore (65) is generally oblong in shape and wherein said bushing is provided with flats (61) to slidably mate with oblong bore (65) to prevent said bushing from inopportune rotation during tightening of handle (69) on said bushing.

23. The device of claim 20 wherein said sealing periphery (186) comprises circumferential portions of a tapered wall (158) of a generally stopper shaped body (241), and wherein said force applicator shoulder structure comprises a cap portion (41) of said body (241), whereby an operators fingers can grip (41) and either push body (241) into a tube or pull said body therefrom.

24. The device of claim 20 wherein said seal comprises a body (56) of resilient, elastomeric material having a bushing bore (11) formed axially therethrough, wherein said force applicator shoulder structure provides seal body clamping structure comprising a pressure cap member (41) having a top portion (67) having a proximal pressure surface (159), a distal pressure surface (175) and a depending compression wall portion (87) having an inner cylindrical pressure surface (31) defining a tube receiving cavity (177), a bushing bore (65) axially formed thru said top portion an elongated bushing (164) mounted axially thru said bore (65) and having a proximal threaded stem portion (73) and a distal pressure plate portion (166) having a pressure surface (151), wherein a mixer shaft bore (168) is provided axially thru said bushing, wherein ends (182) and (184) of body (56) are adapted to be forcefully engaged by distal pressure surface (175) and pressure surface (151), and wherein a threaded compression handle (69) is threaded onto stem portion (73) and is adapted to be tightened against surface (159) to clamp and radially bulge seal body (56) against the tube wall surface 188 and to force portions (27) of a tube having its filler end positioned in said cavity (177) radially against the inner pressure surface (31) of compression wall portion (87) to thereby further frictionally lock said tube to said device.

25. The device of claim 24 wherein a mixer shaft seal structure (64) is frictionally mounted in a recess (261) formed in plate (166) and is provided with an elastomeric seal member (137) having a circular bore (253) thru which shaft (32) is frictionally slidably mounted.

26. The device of claim 25 wherein said seal member (137) is in the general shape of a cup with the rim thereof facing in a proximal direction.

27. The device of claim 20 wherein said circular sealing periphery comprises a circular segment (24) of cylindrical recess wall (57), and said force applicator shoulder structure comprises a top portion pressure cap (41) which can be gripped by the operators hand while said filler end is being forced up into (41).

28. The device of claim 27 wherein said wall (57) is tapered outwardly from its proximal end (263) to its distal end (265) at an angle of from 1–5 degrees with respect to parallels (267) and (291) of axis (30).

* * * * *